US006028524A

United States Patent [19]

Hartman et al.

[11] Patent Number: 6,028,524

[45] Date of Patent: Feb. 22, 2000

[54] METHOD FOR MONITORING THE POSITION OF A MOTOR GRADER BLADE RELATIVE TO A MOTOR GRADER FRAME

[75] Inventors: Matthew A. Hartman, Bloomington; Xiaojun Zhang, Peoria; Mark D. Shane, Princeville; Daniel E. Shearer, Metamora, all of Ill.

[73] Assignee: Caterpillar Inc., Peoria, Ill.

[21] Appl. No.: 09/216,550

[22] Filed: Dec. 18, 1998

[51] Int. Cl.[7] ..... G08B 21/00

[52] U.S. Cl. ..... 340/686.6; 340/686.1; 340/686.2; 340/686.3; 340/686.5; 340/684; 172/4.5; 172/5; 172/6; 172/784; 701/50

[58] Field of Search ..... 340/680, 679, 340/684, 686.1, 686.2, 686.3, 686.5, 686.6; 172/3, 4, 4.5, 5, 6, 799, 233, 784; 701/45, 50; 37/907, 214

[56] References Cited

U.S. PATENT DOCUMENTS

| | | | |
|---|---|---|---|
| 3,675,229 | 7/1972 | Rink | 172/4 |
| 3,876,012 | 4/1975 | Regier | 172/4 |
| 3,904,051 | 9/1975 | Tsuchiya et al. | 414/694 |
| 4,053,017 | 10/1977 | Gill et al. | 172/4.5 |
| 4,157,118 | 6/1979 | Suganami et al. | 172/4.5 |
| 4,524,836 | 6/1985 | Pehrson | 172/4.5 |
| 4,643,261 | 2/1987 | Long | 172/2 |
| 4,744,218 | 5/1988 | Edwards et al. | 60/368 |
| 4,799,625 | 1/1989 | Weaver, Jr. et al. | 241/30 |
| 4,863,337 | 9/1989 | Ishiguro et al. | 414/699 |
| 5,479,729 | 1/1996 | Eslambolchi | 37/195 |
| 5,647,439 | 7/1997 | Burdick et al. | 172/4.5 |
| 5,704,141 | 1/1998 | Miura et al. | 37/348 |
| 5,735,065 | 4/1998 | Yamagata et al. | 37/348 |

*Primary Examiner*—Benjamin C. Lee
*Attorney, Agent, or Firm*—Howard & Howard

[57] ABSTRACT

A system and method for monitoring the position of a motor grader blade relative to a motor grader frame. The method includes the steps of: providing an electronic controller, blade controls having position sensors, and frame controls having position sensors; monitoring the output of the position sensors to ascertain the position of the blade controls and the frame controls; receiving an input signal requesting a repositioning of the blade or the frame; determining the present blade position and the present frame position; calculating a future blade position and a future frame position based on the repositioning request; predicting an intersection of the future blade position and the future frame position; and producing an action to prevent the intersection of the future blade position and the future frame position.

5 Claims, 5 Drawing Sheets

METHOD FOR MONITORING THE POSITION OF A MOTOR GRADER BLADE RELATIVE TO A MOTOR GRADER FRAME

TECHNICAL FIELD

The present invention relates generally to a method for monitoring the position of a motor grader blade relative to a motor grade frame and, more particularly, for automatically preventing contact between the blade and the frame.

BACKGROUND ART

Motor graders are used primarily as a finishing tool to sculpt a surface of earth to a final arrangement. Typically, motor graders include many hand-operated controls to steer the wheels of the grader, position the blade, and articulate the front frame of the grader. The blade is adjustably mounted to the front frame to move relatively small quantities of earth from side to side. The articulation angle is adjusted by rotating the front frame of the grader relative to the rear frame of the grader.

To produce a variety of final earth arrangements, the blade and the frame may be adjusted to many different positions. On most motor graders, it is possible for an operator to adjust the blade or the frame such that the blade collides with a tire or the frame and damages the motor grader. To forestall such operator-induced damage, it is desirable to provide a method for automatically preventing contact between the blade and the frame.

DISCLOSURE OF THE INVENTION

The present invention provides a method for monitoring the position of a motor grader blade relative to a motor grader frame. The method includes the steps of: providing an electronic controller, blade controls having position sensors, and frame controls having position sensors; monitoring the output of the position sensors to ascertain the position of the blade controls and the frame controls; receiving an input signal requesting a repositioning of the blade or the frame; determining the present blade position and the present frame position; calculating a future blade position and a future frame position based on the repositioning request; predicting an intersection of the future blade position and the future frame position; and producing an action to prevent the intersection of the future blade position and the future frame position.

BEST MODE FOR CARRYING OUT THE INVENTION

Figure 1:
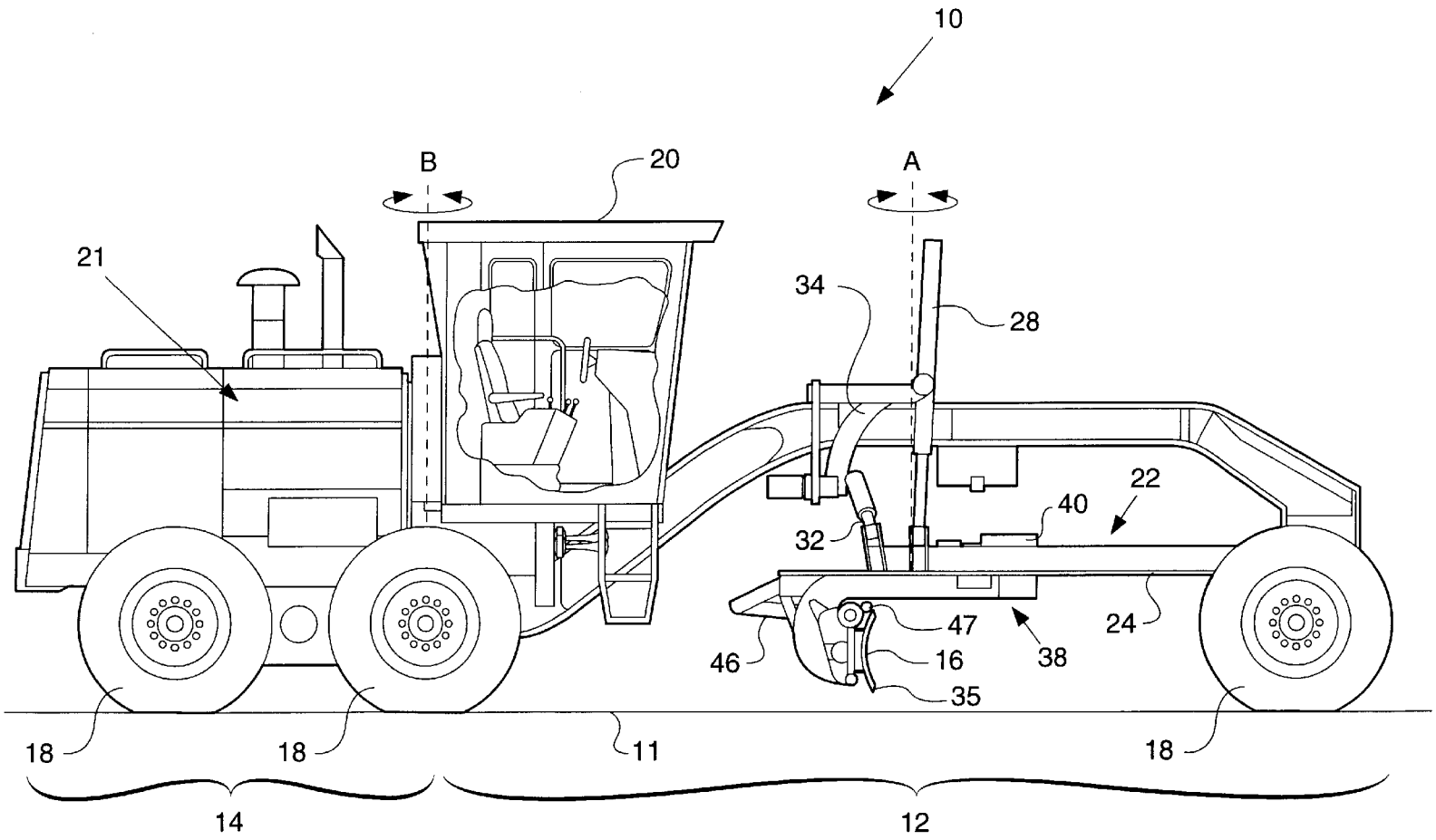
FIG. 1 is a side view of a motor grader.
Figure 2:
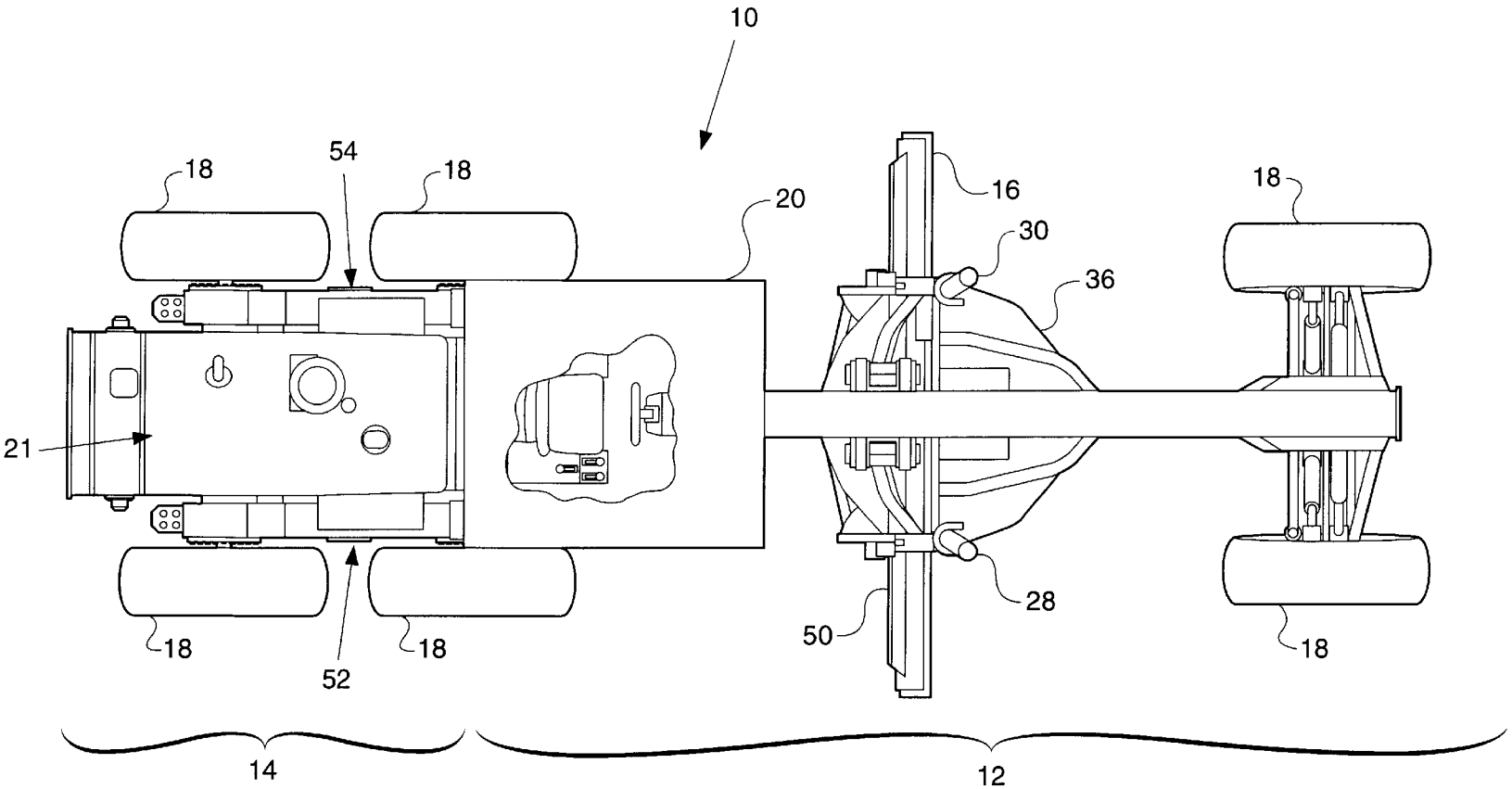
FIG. 2 is a top view of the motor grader.

Referring to the Figures, wherein like numerals indicate like or corresponding parts throughout the several views, a motor grader is shown generally at 10 in FIGS. 1 and 2. The motor grader 10 is used primarily as a finishing tool to sculpt a surface of earth 11 to a final arrangement. Rather than moving large quantities of earth in the direction of travel like other machines, such as a bulldozer, the motor grader 10 typically moves relatively small quantities of earth from side to side. In other words, the motor grader 10 typically moves earth across the area being graded, not straight ahead.

The motor grader 10 includes a front frame 12, a rear frame 14, and a blade 16. The front and rear frames 12 and 14 are supported by tires 18. An operator cab 20 containing the many controls necessary to operate the motor grader 10 is mounted on the front frame 12. An engine, shown generally at 21, is used to drive or power the motor grader 10. The engine 21 is mounted on the rear frame 14. The blade 16, sometimes referred to as a moldboard, is used to move earth. The blade 16 is mounted on a linkage assembly, shown generally at 22. The linkage assembly 22 allows the blade 16 to be moved to a variety of different positions relative to the motor grader 10. Starting at the front of the motor grader 10 and working rearward toward the blade 16, the linkage assembly 22 includes a drawbar 24.

The drawbar 24 is mounted to the front frame 12 with a ball joint. The position of the drawbar 24 is controlled by three hydraulic cylinders, commonly referred to as a right lift cylinder 28, a left lift cylinder 30, and a centershift cylinder 32. A coupling, shown generally at 34, connects the three cylinders 28, 30, and 32 to the front frame 12. The coupling 34 can be moved during blade repositioning but is fixed stationary during earthmoving operations. The height of the blade 16 with respect to the surface of earth 11 below the motor grader 10, commonly referred to as blade height, is controlled primarily with the right and left lift cylinders 28 and 30. The right and left lift cylinders 28 and 30 can be controlled independently and, thus, used to angle a bottom cutting edge 35 of the blade 16 relative to the surface of earth 11. The centershift cylinder 32 is used primarily to sideshift the drawbar 24, and all the components mounted to the end of the drawbar, relative to the front frame 12. This sideshift is commonly referred to as drawbar sideshift or circle centershift.

Figure 3:
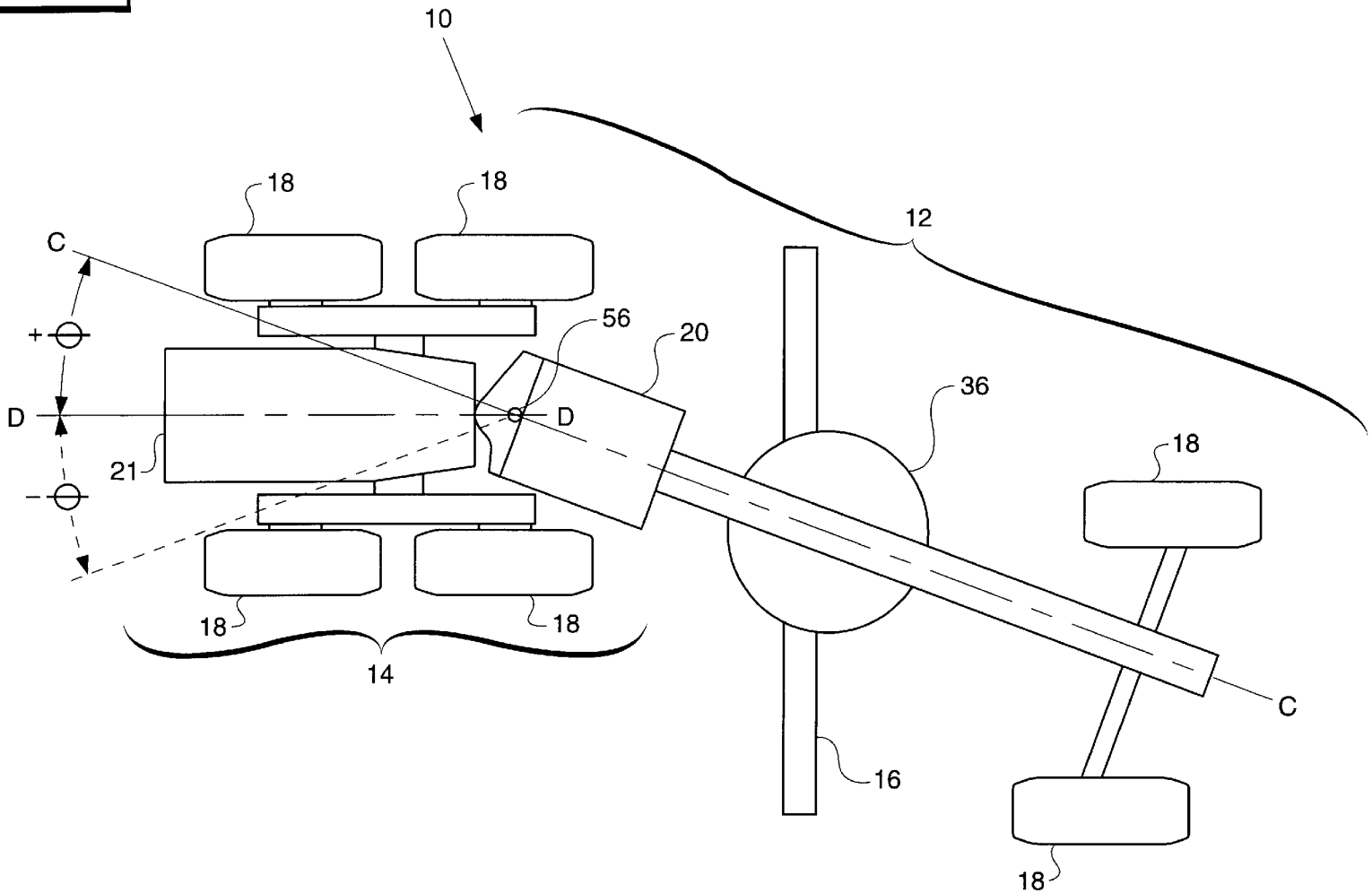
FIG. 3 is a top schematic view of the motor grader rotated to a full right articulation angle.

The drawbar 24 includes a large, flat plate, commonly referred to as a yoke plate 36, as shown in FIGS. 2 and 3. Beneath the yoke plate 36 is a large gear, commonly referred to as a circle 38. The circle 38 is rotated by a hydraulic motor, commonly referred to as a circle drive 40, as shown in FIG. 2. The rotation of the circle 38 by the circle drive 40, commonly referred to as circle turn, pivots the blade 16 about an axis A fixed to the drawbar 24 to establish a blade cutting angle. The blade cutting angle is defined as the angle of the blade 16 relative to the front frame 12. At a zero degree blade cutting angle, the blade 16 is aligned at a right angle to the front frame 12. In FIG. 2, the blade 16 is set at a zero degree blade cutting angle.

The blade 16 is mounted to a hinge on the circle 38 with a bracket. A blade tip cylinder 46 is used to pitch the bracket forward or rearward. In other words, the blade tip cylinder 46 is used to tip a top edge 47 of the blade 16 ahead of or behind the bottom cutting edge 35 of the blade 16. The position of the top edge 47 of the blade 16 relative to the bottom cutting edge 35 of the blade 16 is commonly referred to as blade tip.

The blade 16 is mounted to a sliding joint in the bracket allowing the blade 16 to be slid or shifted from side to side relative to the bracket or the circle 38. This side to side shift is commonly referred to as blade sideshift. A sideshift cylinder 50 is used to control the blade sideshift.

Referring now to FIG. 2, a right articulation cylinder, shown generally at 52, is mounted to the right side of the rear frame 14 and a left articulation cylinder, shown generally at 54, is mounted to the left side of the rear frame 14. The right and left articulation cylinders 52 and 54 are used to rotate the front frame 12 about an axis B shown in FIG. 1. The axis B is commonly referred to as the articulation axis. In FIG. 2, the motor grader 10 is positioned in a neutral or zero articulation angle.

FIG. 3 is a top schematic view of the motor grader 10 with the front frame 12 rotated to a full right articulation angle +θ. The articulation angle θ is formed by the intersection of the longitudinal axis C of the front frame 12 and the longitudinal axis D of the rear frame 14. An articulation joint 56 connects the front frame 12 and the rear frame 14. A rotary sensor, used to measure the articulation angle θ, is positioned at the articulation joint 56. A full left articulation angle −θ, shown in phantom lines in FIG. 3, is a mirror image of the full right articulation angle +θ. The motor grader 10 may be operated with the front frame 12 rotated to the full right articulation angle +θ, the full left articulation angle −θ, or any angle therebetween.

Figure 4:
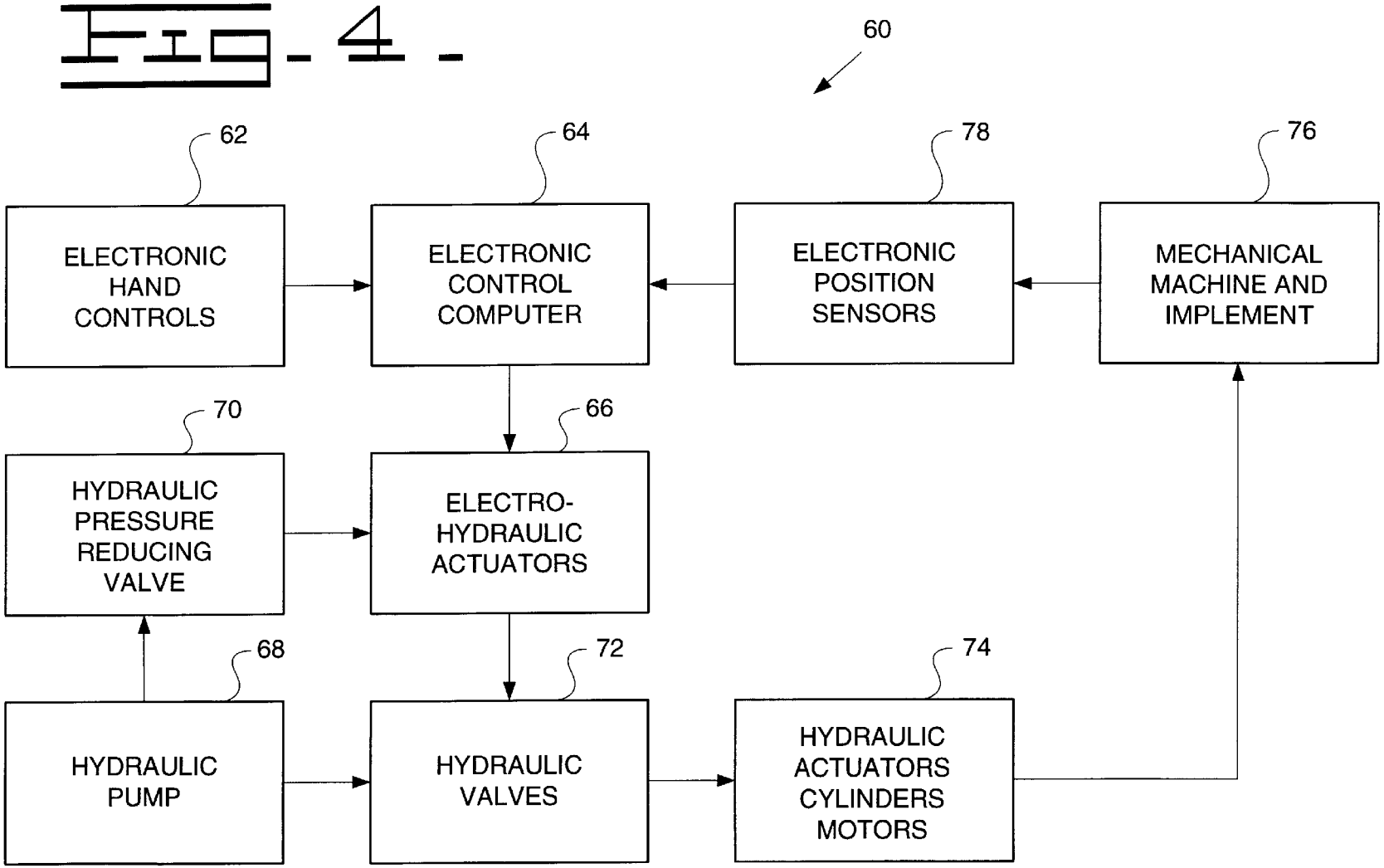
FIG. 4 is a schematic block diagram of an electro-hydraulic control system for the motor grader.

FIG. 4 is a schematic block diagram of an electro-hydraulic control system 60 for the motor grader 10. The control system 60 is designed to control the blade 16 and the articulation angle θ. The system 60 includes electronic hand controls, represented by block 62, which transform the actions of an operator's hands into electrical input signals. These input signals carry operational information to an electronic control computer, represented by block 64.

The control computer 64 receives the electrical inputs signals produced by the hand controls 62, processes the operational information carried by the input signals, and transmits control signals to drive solenoids in electro-hydraulic actuators, represented by block 66.

The hydraulic portion of the control system 60 requires both high hydraulic pressure and low pilot pressure. High hydraulic pressure is provided by a hydraulic pump, represented by block 68. The hydraulic pump 68 receives a rotary motion, typically from the engine 21 of the motor grader 10, and produces high hydraulic pressure. Low pilot pressure is provided by a hydraulic pressure reducing valve, represented by block 70. The hydraulic pressure reducing valve 70 receives high hydraulic pressure from the hydraulic pump 68 and supplies low pilot pressure to the electro-hydraulic actuators 66.

Each electro-hydraulic actuator 66 includes an electrical solenoid and a hydraulic valve. The solenoid receives control signals from the electronic control computer 64 and produces a controlled mechanical movement of a core stem of the actuator 66. The hydraulic valve receives both the controlled mechanical movement of the core stem of the actuator 66 and low pilot pressure from the hydraulic pressure reducing valve 70 and produces controlled pilot hydraulic pressure for hydraulic valves, represented by block 72.

The hydraulic valves 72 receive both controlled pilot hydraulic pressure from the electro-hydraulic actuators 66 and high hydraulic pressure from the hydraulic pump 68 and produce controlled high hydraulic pressure for hydraulic actuators, cylinders, and motors, represented by block 74.

The hydraulic actuators, cylinders, and motors 74 receive controlled high hydraulic pressure from the hydraulic valves 72 and produce mechanical force to move the front frame 12 of the grader 10 and several mechanical linkages, represented by block 76. As described above, movement of the front frame 12 of the grader 10 with respect to the rear frame 14 of the grader 10 establishes the articulation angle θ. Movement of the mechanical linkages establishes the position of the blade 16.

Each hydraulic actuator, cylinder, and motor 74, such as the lift cylinders 28 and 30 and the circle drive motor 40, includes an electronic position sensor, represented by block 78. The electronic position sensors 78 transmit information regarding the position of its respective hydraulic actuator, cylinder, or motor 76 to the electronic control computer 64. In this manner, the control computer 64 can determine the position the blade 16. The control computer 64 further receives articulation angle information from the rotary sensor, also represented by block 78, positioned at the articulation joint 56. With such position and angle information, the control computer 64 can perform additional operations.

In accordance with the scope of the present invention, one such operation is automatically preventing contact between the blade 16 and the front frame 12 or tires 18. Thus, the present invention provides a method for monitoring the position of a motor grader blade relative to a motor grader frame. The method includes the steps of: providing an electronic controller, blade controls having position sensors, and frame controls having position sensors; monitoring the output of the position sensors to ascertain the position of the blade controls and the frame controls; receiving an input signal requesting a repositioning of the blade or the frame; determining the present blade position and the present frame position; calculating a future blade position and a future frame position based on the repositioning request; predicting an intersection of the future blade position and the future frame position; and producing an action to prevent the intersection of the future blade position and the future frame position.

In a first embodiment, the step of producing an action to prevent the intersection of the future blade position and the future frame position includes the steps of canceling the repositioning request and/or producing a warning signal.

In a second embodiment, the step of calculating a future blade position and a future frame position based on the repositioning request includes the step of determining the volume of space that the blade will occupy in a future blade position and the volume of space that the frame will occupy in a future frame position based on the repositioning request, and the step of predicting an intersection of the future blade position and the future frame position includes the step of predicting an intersection of the future blade position volume and the future frame position volume.

Figure 5:
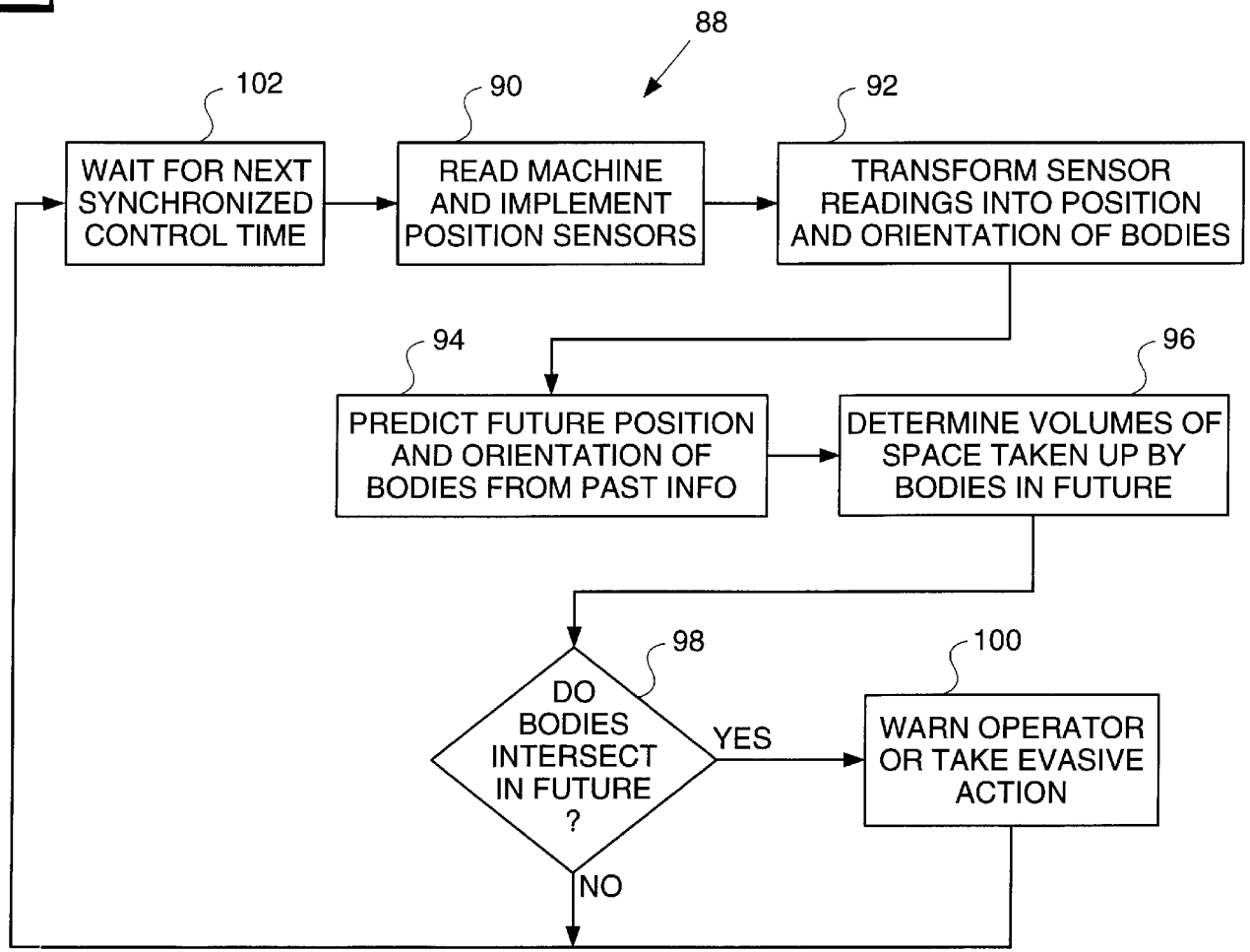
FIG. 5 is a flow chart illustrating a method for monitoring the position of a motor grader blade relative to a motor grader frame in accordance with the present invention.

Referring now to FIG. 5, a flow chart illustrating a preferred method 88 for monitoring the position of a motor grader blade relative to a motor grade frame is shown. As will be appreciated by one of ordinary skill in the art, although the flow chart illustrates sequential steps, the particular order of processing is not important to achieving the objects of the present invention. As will also be recognized, the method illustrated may be performed in software, hardware, or a combination of both as in a preferred embodiment of the present invention.

In the preferred method 88, the output of the position sensors, which indicate the position of the blade and frame controls, are read by the controller upon receipt of an input signal requesting the repositioning of the blade or the frame, as represented by block 90. The controller transforms the respective sensor readings into a blade position and orientation as well as a frame position and orientation, as illustrated by block 92. Based on the repositioning request, the controller predicts the future position and orientation of the blade as well as the future position and orientation of the frame, as represented by block 94. With this position and orientation information, the controller determines the volumes of space filled by the blade body and the frame body, as illustrated by block 96. The controller calculates whether the future position and orientation of the blade and the future position and orientation of the frame will intersect, as represented by block 98. If the blade and frame bodies will intersect, then the operator is warned or evasive action is taken, as illustrated by block 100, and the program waits for the next synchronized control time, as represented by block 102. If the blade and frame bodies will not intersect, then the program waits for the next synchronized control time, as represented by block 102.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

Industrial Applicability

The present invention relates generally to a method for monitoring a motor grader blade relative to a motor grader frame. The method uses an electronic controller, blade controls having position sensors, and frame controls having position sensors. The controller monitors the output of the position sensors to ascertain the position of the blade controls and the frame controls. Upon receiving an input signal requesting a repositioning of the blade or the frame, the controller determines the present blade position and the present frame position as well as calculates a future blade position and a future frame position based on the repositioning request. If a collision of the future blade position and the future frame position is predicted, the controller produces an action to prevent the collision. In this manner, an operator is automatically warned or prohibited from adjusting either the blade or the frame if an adjustment requested by the operator will result in contact between the blade and the frame or tires.

We claim:

1. A method for monitoring the position of a motor grader blade relative to a motor grader frame comprising the steps of:

providing an electronic controller, blade controls having position sensors, and frame controls having position sensors;

monitoring the output of the position sensors to ascertain the position of the blade controls and the frame controls;

receiving an input signal requesting a repositioning of the blade or the frame;

determining the present blade position and the present frame position;

calculating a future blade position and a future frame position based on the repositioning request;

predicting an intersection of the future blade position and the future frame position; and producing an action to prevent the intersection of the future blade position and the future frame position.

2. A method as set forth in claim 1 wherein the step of producing an action to prevent the intersection of the future blade position and the future frame position includes the step of canceling the repositioning request.

3. A method as set forth in claim 1 wherein the step of producing an action to prevent the intersection of the future blade position and the future frame position includes the step of producing a warning signal.

4. A method as set forth in claim 1 wherein the step of calculating a future blade position and a future frame position based on the repositioning request includes the step of determining the volume of space that the blade will occupy in a future blade position and the volume of space that the frame will occupy in a future frame position based on the repositioning request.

5. A method as set forth in claim 4 wherein the step of predicting an intersection of the future blade position and the future frame position includes the step of predicting an intersection of the future blade position volume and the future frame position volume.

* * * * *